United States Patent [19]

Allen

[11] 4,349,328

[45] Sep. 14, 1982

[54] TRIANGULAR TRUSS CONCRETE SCREED HAVING A PAN FLOAT FINISHER ATTACHMENT

[75] Inventor: J. Dewayne Allen, Paragould, Ark.

[73] Assignee: Allen Engineering Corporation, Paragould, Ark.

[21] Appl. No.: 264,050

[22] Filed: May 15, 1981

Related U.S. Application Data

[62] Division of Ser. No. 34,171, Apr. 26, 1979, Pat. No. 4,316,715.

[51] Int. Cl.[3] ..... E01C 19/38

[52] U.S. Cl. ..... 425/456; 404/119; 425/458

[58] Field of Search ..... 404/118, 119, 120, 97; 425/456, 458

[56] References Cited

U.S. PATENT DOCUMENTS

| | | | |
|---|---|---|---|
| 2,226,466 | 12/1940 | Heltzel | 404/119 |
| 3,137,219 | 6/1964 | Hudix | 404/119 |
| 3,403,609 | 10/1968 | Bradshaw et al. | 404/118 |

FOREIGN PATENT DOCUMENTS

| | | | |
|---|---|---|---|
| 618611 | 4/1961 | Canada | 404/119 |
| 694624 | 9/1964 | Canada | 404/118 |
| 974825 | 11/1964 | United Kingdom | 404/119 |

*Primary Examiner*—James B. Lowe
*Attorney, Agent, or Firm*—Cahill, Sutton & Thomas

[57] ABSTRACT

A triangular truss screed includes a frame having first and second ends and a top support member which forms the apex of the triangular truss. Front and rear screed blades extend between the first and second ends of the screed frame and are coupled in a spaced apart relationship to the lower portion of the front and rear of the frame. The front and rear screed blades each include a flat lower surface and form the front and rear edges of the triangular truss frame. A pan float finisher is coupled to the flat lower surface of the front and rear blades and includes a length substantially equal to the length of the screed frame and a width greater than the spacing between the front and rear blades. A vibration generating mechanism is coupled to the screed to vibrate the pan float finisher.

6 Claims, 17 Drawing Figures

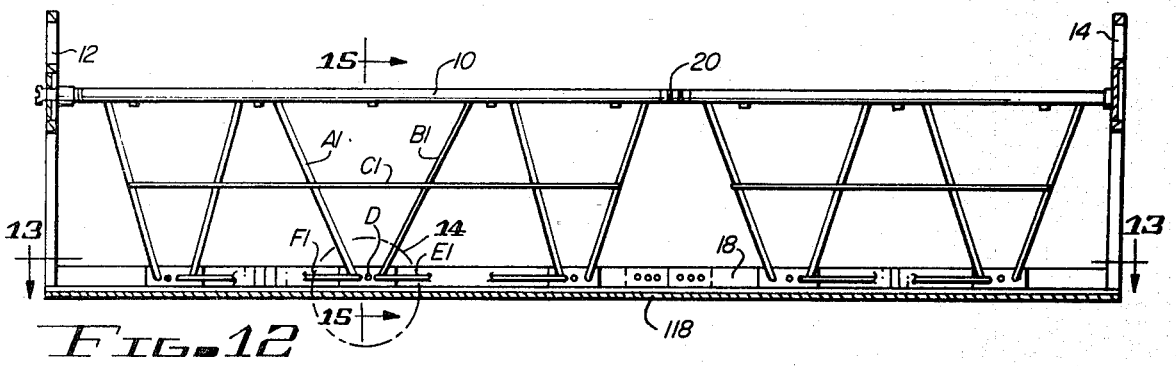
FIG. 12
FIG. 13
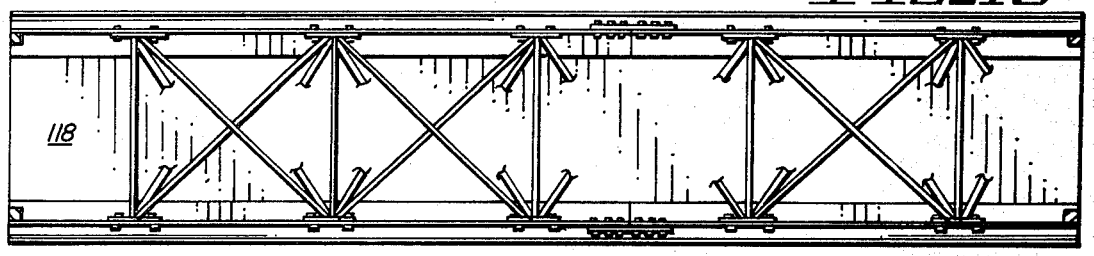
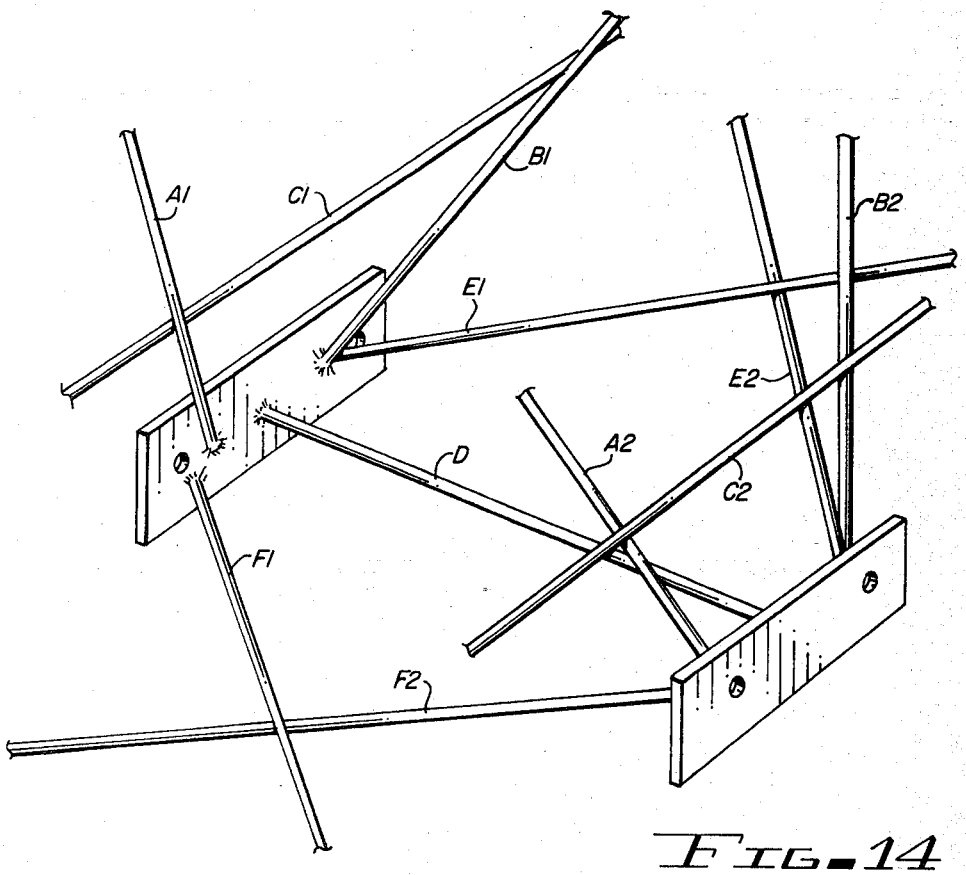
FIG. 14

TRIANGULAR TRUSS CONCRETE SCREED HAVING A PAN FLOAT FINISHER ATTACHMENT

This is a division of application Ser. No. 034,171, filed Apr. 26, 1979, now U.S. Pat. No. 4,316,715.

BACKGROUND OF THE INVENTION

1. Field of the Invention

This invention relates to concrete screeds, and more particularly, open frame vibratory screeds.

2. Description of the Prior Art

A wide variety of vibrating concrete screeds are disclosed in the prior art. An open frame, vibrating screed is manufactured by the H. Compton Company of Conroe, Texas, and includes a plurality of penumatic vibrators mounted at intervals on front and rear screed blades. This screed is fabricated in variable length sections, is translatable over a freshly poured concrete surface by a pair of winches and can be adjusted to provide a variable contour for the surface of the concrete being screeded. Another related concrete screed is manufactured by AWS Manufacturing, Inc. of Naperville, Ill. The AWS concrete screed also includes a wall mounting bracket attachment which is bolted to an end bracket of the screed and includes a single length of angle iron which engages the top and side surfaces of a 2×4 wall mounted guide rail. U.S. Pat. No. 4,030,873 (Morrison) discloses a multi-element concrete screed having variable length elements and a rotating shaft which extends along the length of the screed for imparting uniform vibrations to the front and rear screed blades. All of the above described concrete screeds are vertically supported above opposing, parallel oriented side forms.

U.S. Pat. No. 3,110,234 (Oster) discloses a concrete screed having vertically adjustable blades which are translatable along parallel oriented rails. U.S. Pat. No. 3,435,740 (McGall) discloses a concrete screed including a hand operated winch for laterally translating the screed and a turnbuckle system for adjusting the concrete surface contour formed by the various sections of the screed.

U.S. Pat. No. 2,542,979 (Barnes) discloses a concrete screed having an inverted T-shaped screed blade and electric motor for imparting a vibratory motion to the screed blade.

U.S. Pat. No. 3,883,259 (Berg) discloses another concrete screed having parallel oriented blades and means for imparting vibratory motion to the blades.

The following U.S. Patents disclosed other concrete screed configurations: U.S. Pat. No. 2,372,163 (Whiteman); U.S. Pat. No. 1,386,348 (Maxon); U.S. Pat. No. 2,866,394 (Smith); U.S. Pat. No. 3,008,388 (Nave); U.S. Pat. No. 4,073,593 (Storm); U.S. Pat. No. 3,095,789 (Melvin); U.S. Pat. No. 3,523,494 (Kraemer); U.S. Pat. No. 2,219,247 (Jackson); U.S. Pat. No. 3,113,494 (Barnes); U.S. Pat. No. 2,693,136 (Barnes) and U.S. Pat. No. 4,105,355 (King).

SUMMARY OF THE INVENTION

The present invention contemplates a vibrating concrete screed system including a fixed blade extension bracket, an adjustable blade extension bracket, a detachable guide bracket, a detachable pan float finisher and a center mounted winch attachment. Each of these attachments can be readily coupled to a screed which converts freshly poured concrete freshly poured concrete lying in an area between opposing side forms into a smooth, finished concrete surface. The screed of this system comprises a frame having first and second ends, front and rear screed blades coupled in a spaced apart relationship to the lower portion of the front and rear of the frame to shape the upper surface of the concrete, and first and second end brackets which are coupled to the first and second ends of the frame.

The fixed blade extension bracket can be coupled to either or both ends of the screed and includes a front blade extension which is coupled in alignment with the front screed blade to extend the overall length of the front blade by a predetermined desired amount. The fixed blade extension bracket also includes a rear blade extension which is coupled in alignment with the rear screed blade to extend the overall length of the rear blade by a predetermined desired amount.

The adjustable blade extension bracket can be coupled to either one or both of the end brackets and includes horizontally adjustable front and rear blade sections, and means for coupling the front and rear blade sections to the first and second side members of an end bracket to permit the adjustable end bracket to be coupled at selected vertical positions to the end bracket while maintaining the front and rear blade sections in parallel alignment with the front and rear screed blades.

The detachable guide bracket functions to guide one end of the screed along a wall mounted, horizontally oriented guide member. The guide bracket includes a first vertically oriented side member, a second vertical oriented side member, means for detachably coupling the first and second side members to an end bracket of the screed, and guide means laterally extending from the first and second side members for contacting the guide member to maintain the screed at a predetermined desired vertical position as the guide means is laterally translated along the length of the guide member.

The detachable bottom pan is positioned between the first and second end brackets of the screen and includes a front edge which is coupled to the front screed blade and a rear edge which is coupled to the rear screed blade.

Certain embodiments of the screed of the present invention include first and second winches which are coupled to the first and second end brackets and include lines extending from the first and second winches which are coupled to a stationary object for exerting a traction force on the first and second end brackets of the screed when the lines are reeled in by the first and second winches. A detachable, center mounted winch may also be provided. The center mounted winch attachment includes a line extending from the winch to a stationary object for permitting the center mounted winch to exert a traction force on the central section of the screed to permit uniform translation of the entire length of the screed.

DESCRIPTION OF THE DRAWINGS

The invention is pointed out with particularity in the appended claims. However, other objects and advantages together with the operation of the invention may be better understood by reference to the following detailed description taken in connection with the following illustrations wherein:

FIG. 12 is an elevational view of the screed illustrated in FIG. 1, taken along section line 12—12.

FIG. 13 is a view from above of the screed illustrated in FIG. 12, taken along section line 13—13.

FIG. 14 is an enlarged view of a section of the screed shown in FIG. 13, particularly illustrating the structure and relative orientation of the truss members of the screed.

DESCRIPTION OF THE PREFERRED EMBODIMENT

In order to better illustrate the advantages of the present invention and its contributions to the art, a preferred hardware embodiment of the inventive system will now be described in some detail.

Figure 1:
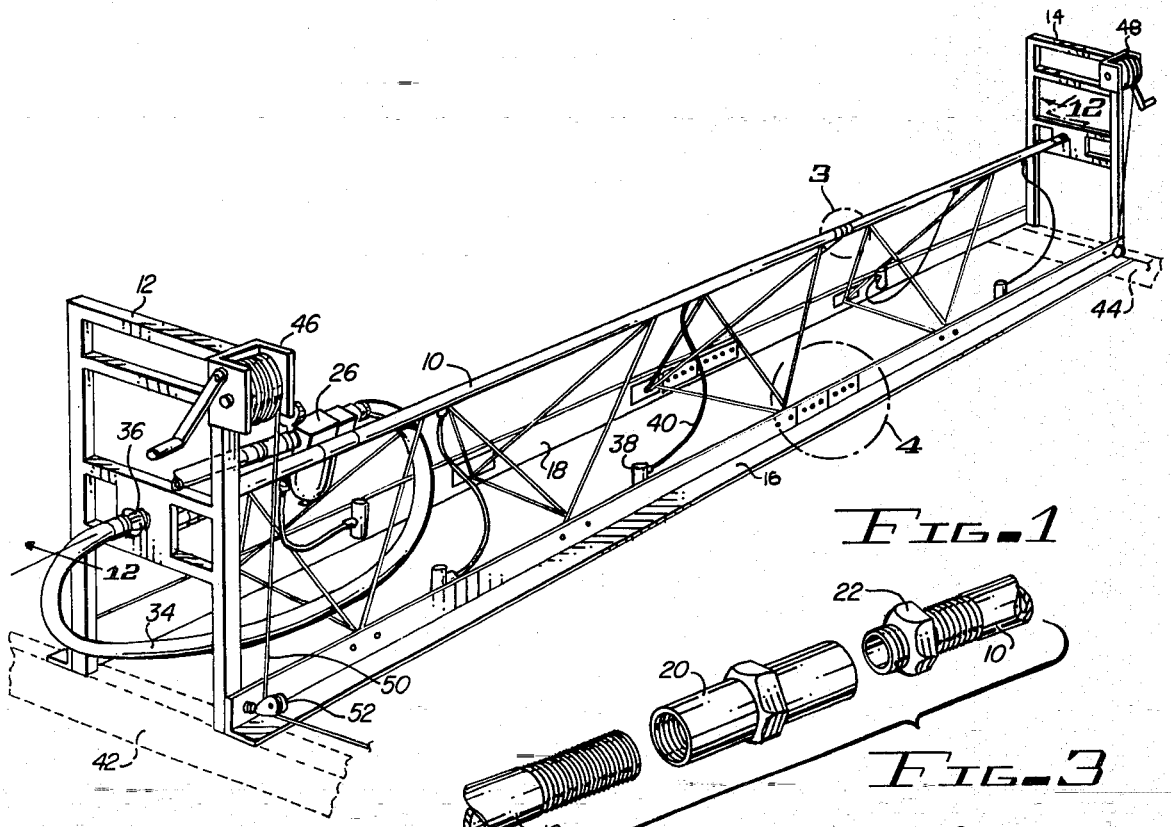
FIG. 1 is a perspective view of a two section screed in accordance with the present invention.
Figure 2:
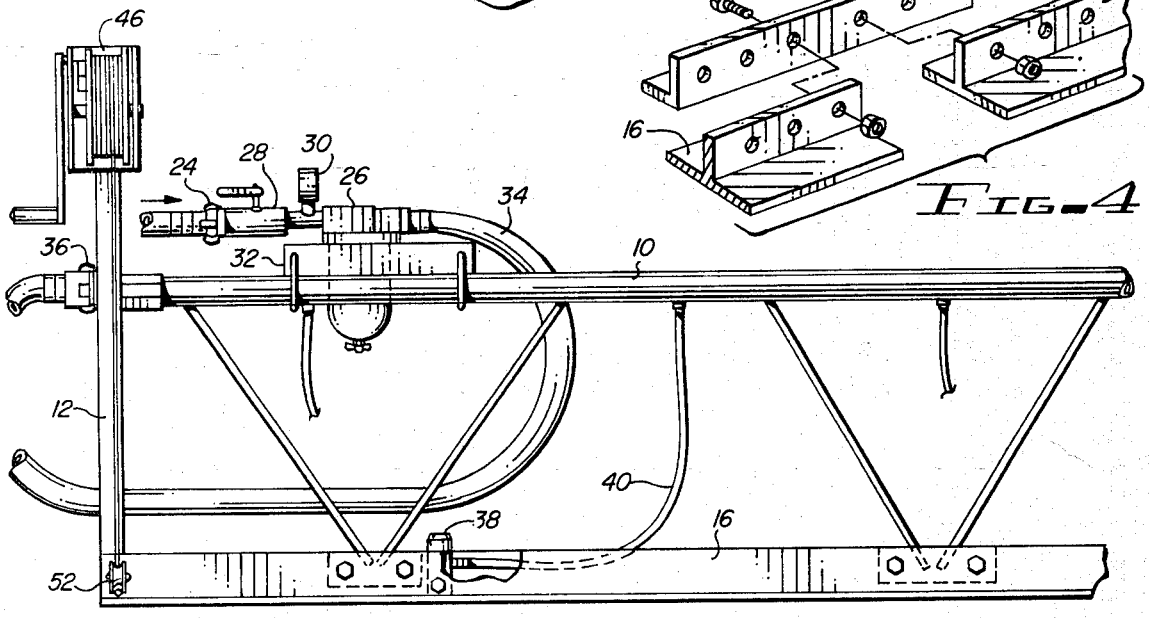
FIG. 2 is a partial elevational view of the left hand portion of the screed illustrated in FIG. 1.

Referring now to FIGS. 1 and 2, the vibrating concrete screed which forms the primary element of the screed system will be described. In many figures numerous support structures have been delected in the interst of more clearly illustrating other elements of the invention. The specific configuration of the open frame support structure will be fully described in connection with FIGS. 12, 13 and 14.

A horizontally oriented air transport pipe 10 extends between first and second end brackets 12 and 14. Two L shaped blades coupled back to back form a Tee-shaped front screed blade 16. An L-shaped rear screed blade 18 is also coupled to the first and second end brackets 12 and 14.

In the preferred embodiment the screed is fabricated in 5 foot and 7½ foot lengths, any combination of which can be joined together to form a screed having a length reasonably close to the desired length.

Figure 4:
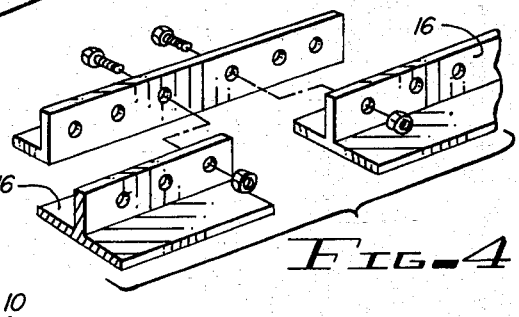
FIG. 4 is an enlarged view of the hardware utilized to join the blade sections of adjacent screed sections.

FIG. 4 illustrates the manner in which a splice plate and a plurality of securing means such as nuts and bolts may be used to couple together abutting ends of each screed blade section.

Figure 3:
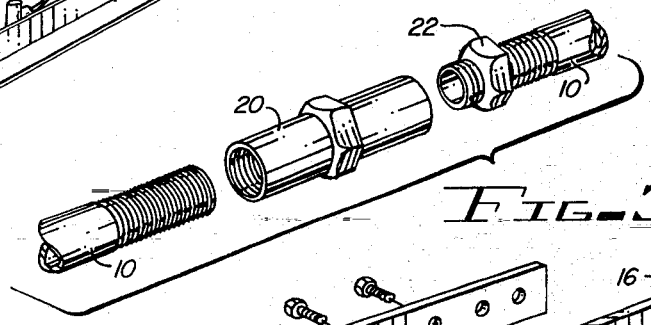
FIG. 3 is an enlarged perspective view of the means for adjusting the contour of the front and rear screed blades.

FIG. 3 illustrates the structure utilized to coupled adjacent sections of air transfer pipe 10 to form a single structural element. Air transfer pipe 10 forms an air tight conduit which supplied a source of air under pressure along the entire length of the screed. The air transfer pipe junction illustrated in FIG. 3 comprises a threaded coupling unit 20 having left hand threads on one end and right hand threads on the other end which is rotatably adjusted to provide the desired angle of incidence between adjacent screed section. This adjustment provides the desired contour on the upper surface of the concrete being screeded. A jam nut 22 locks coupling unit 20 in the desired position.

Referring now to FIGS. 1 and 2, a high volume air compressor unit is coulped by a crow's foot coupling unit 24 to inline lubricator 26. An air control valve 28 and an air pressure gauge 30 are coupled between coupling unit 24 and filter 26. Lubricator 26 and its associated hardware is detachably coupled to air transfer pipe 10 by a pair of spring clips of the type indicated by reference number 32. A flexible air hose 34 is coupled at one end to lubricator 26 and at the other end to air transfer pipe 10 by crow's foot coupling unit 36.

A plurality of penumatic vibrators are coupled at intervals along the length of front screed blade 16 and rear screed blade 18. The pneumatic vibrators are coupled to the vertical face of rear screed blade 18 and to the rear horizontally oriented face of front screed blade 16. An air hose, such as air hose 40, couples each vibrator unit to the source of air under pressure within air transfer pipe 10. The vibrators are generally staggered front to back and are coupled at 30 inch intervals. A vibrator is coupled to the front and rear screed blade 30 inches from both end brackets 12 and 14 to maximize vibration fo the scrred in the vicinity of the side forms. Each air vibrator unit 38 includes a vertically displaceable piston and a pair of air discharge ports in the side of the cylinder wall. The piston within each cylinder vibrates at between 6000 to 8000 cycles per minute when air at approximately 40 PSI is supplied. Air vibrator units of the type used in connection with the present invention are well known to those skilled in the art and are commercially available.

The complete screed unit is translated along the upper surface of opposing side forms 42 and 44 by actuation of winches 46 and 48. These winches can be power driven or manually operated devices. A cable 50 from each winch passes around a pulley 52 which is coupled by bolt through the vertical face of front screed blade 16 to the front vertically oriented member of end bracket 12. The free end of cable 50 is coupled to a stationary object generally aligned with side form 42.

Figure 5:
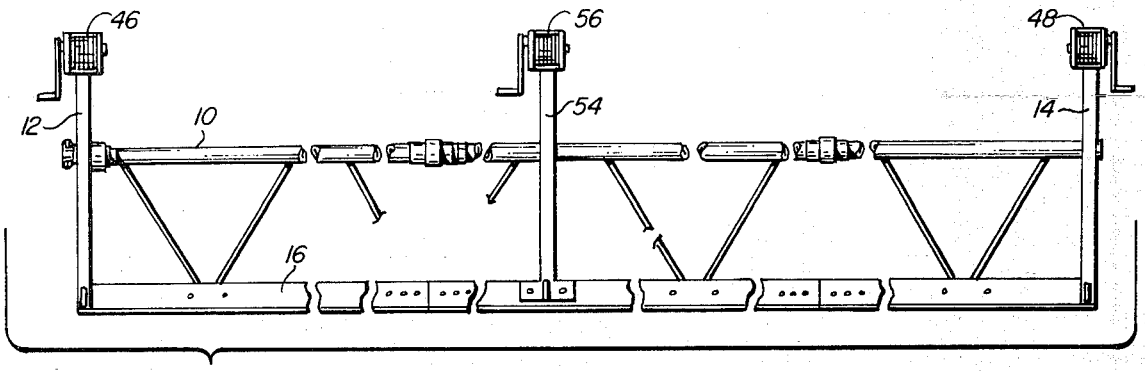
FIG. 5 illustrates the structure and positioning of the center mounted winch attachment.

To prevent bowing of the central portion of a screed having a length around 60 feet or more, a center mounted winch assembly of the type depicted in FIG. 5 is generally utilized. A center mounting bracket 54 of a configuration virtually identical to end brackets 12 and 14 is coupled at the junction between two adjacent screed units in the center of the assembled screed. An additional winch 56 is coupled to the upper portion of bracket 54. The cable extending from winch 56 passes through a pulley in a manner similar to that described in connection with the pulleys for outboard winches 46 and 48. Workmen operate winches 46, 48 and 56 at an equal rate to uniformly translate the screed in the desired direction to prevent bowing of the central portion of the screed.

Figure 6:
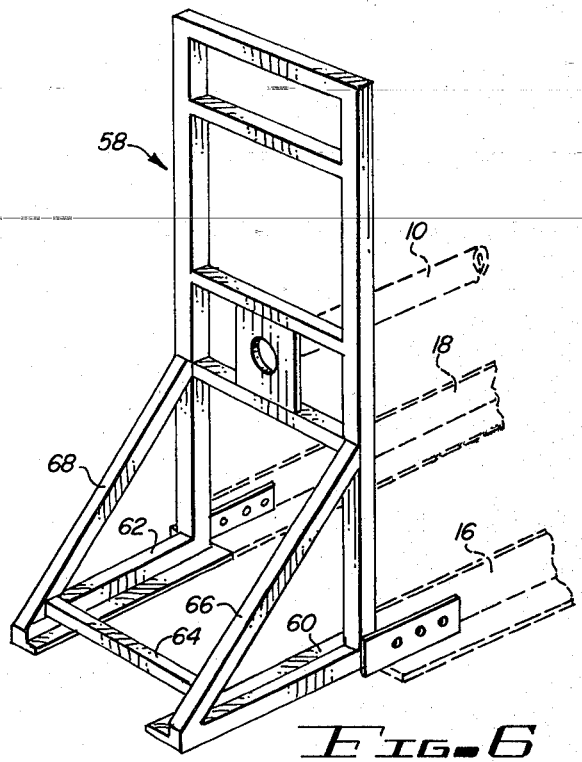
FIG. 6 is a perspective view illustrating a blade extension bracket in accordance with the present invention, and indicating the manner in which the blade extension bracket is coupled to the screed.
Figure 7:
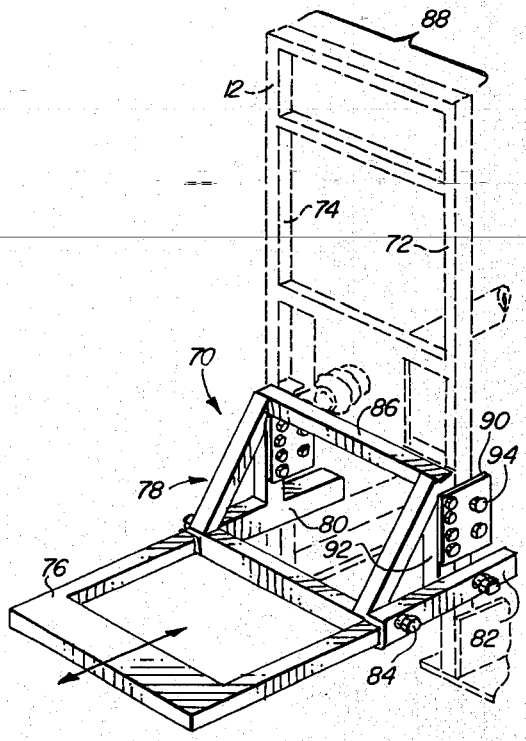
FIG. 7 illustrates the adjustable blade extension bracket of the present invention and the manner of coupling this bracket to an end bracket of the screed.
Figure 10:
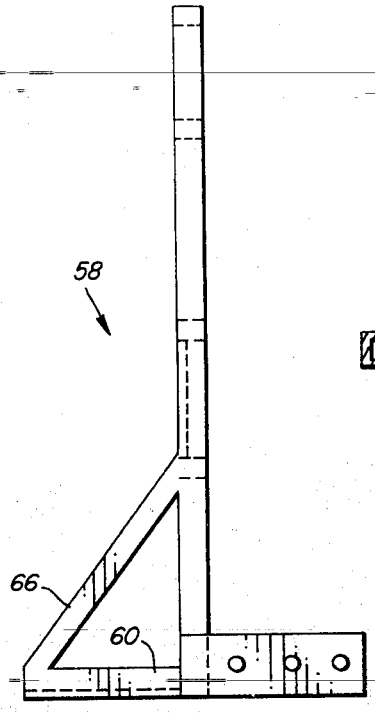
FIG. 10 illustrates a blade extension bracket having a shorter length blade extension than the blade extension bracket illustrated in FIG. 6.

Since it is frequently desirable to more precisely tailor the length of a concrete screed to match the distance between side members 42 and 44 than is permitted by the previously described 5 foot and 7½ foot screed sections, blade extension brackets of various fixed lengths have been provided as is illustrated in FIG. 6 and 10. To incorporate a blade extension bracket 58 into the screed, one or both of the end brackets 12 and 14 are removed from the screed. Extension bracket 58 is then coupled by securing means such as nuts and bolts to the front and rear screed blades. Each extension bracket includes a front blade extension 60 and a rear blade extension 62. As can be seen from FIG. 6 and 10, the length of the front and rear blade extensions can be fabricated in any desired length. In the system of the preferred embodiment, three blade extension brackets having lengths of 6, 12 and 18 inches are provided. Blade extension bracket 48 also includes a horizontally oriented strut 64 which extends between the end portions of blade extensions 60 and 62 to maintain a predetermined fixed spacing therebetween. Angled support struts 66 and 68 are coupled respectively to the outer end of front blade extension 60 and rear blade extension 62 and to the vertically oriented members of blade extension bracket 48. If desired, vibrators may be coupled to the blade extension bracket.

Figure 11:
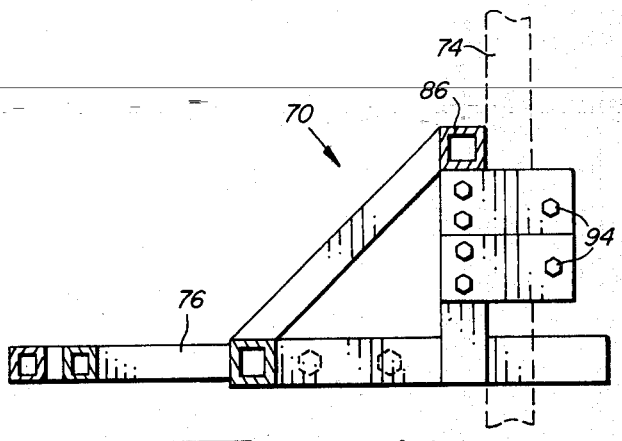
FIG. 11 is a partial sectional view of the adjustable blade extension bracket shown in FIG. 7.
Figure 17:
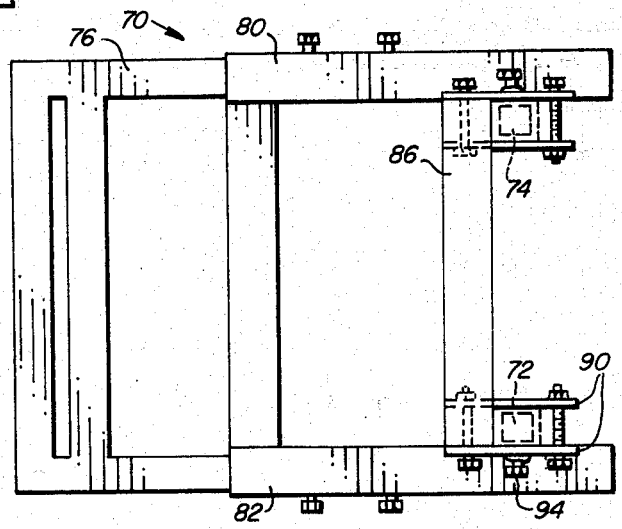
FIG. 17 is a view from above of the adjustable extension bracket shown in FIG. 7.

Referring now to FIGS. 11 and 17, a vertically and horizontally adjustable blade extension bracket 70 will be described. A bracket of this type is particularly desirable when it is necessary to form a step or sidewalk adjacent to the roadbed or warehouse flooring which is being formed by the remainder of the screed. The adjustable blade extension bracket 70 is coupled to the parallel oriented, vertically extending side members 72 and 74 of end bracket 12. Bracket 70 can be divided generally into a telescopically adjustable first section 76 which permits adjustment of the lateral extension of section 76 with respect to end bracket 12. A second vertically adjustable section 78 permits the entire unit to be adjustably secured to side members 72 and 74 of end bracket 12. Section 78 includes a pair of horizontally oriented channel members 80 and 82 which are dimensioned to permit the two telescopically adjustable legs of section 76 to be readily laterally translatable within the interior of sections 80 and 82. Securing means in the form of an adjustable bolt, such as bolt 84, are provided in the sides of channels 80 and 82 to clamp section 76 in the desired lateral position. The horizontal distance between the interior portions of channels 80 and 82 is just sufficient to permit them to be fitted within the interior walls of side members 72 and 74 of end bracket 12.

A horizontally oriented support strut 86 is of a length equal to the horizontally oriented support strut 88 of end bracket 12. The distance between the interior surfaces of channels 80 and 82 is equal to the overall width of strut 88. Pairs of parallel aligned steel plates, such as plate 90 are coupled by securing means, such as a plurality of nuts and bolts, at one end to each vertically extending strut 92 of bracket 70. A second plurality of securing means, such as another set of nuts and bolts, passes behind side member 72 and serves to hold the two parallel aligned steel plates 90 together around side member 72. A third set of bolts, such as bolt 94, are threadably coupled to the exterior of steel plate 90 and when tightened serve to clamp bracket 70 in a predetermined desired vertical position along side members 72 and 74. In the above described manner structure is provided which permits vertical and lateral adjustment of the adjustable blade extension bracket 70.

Figure 8:
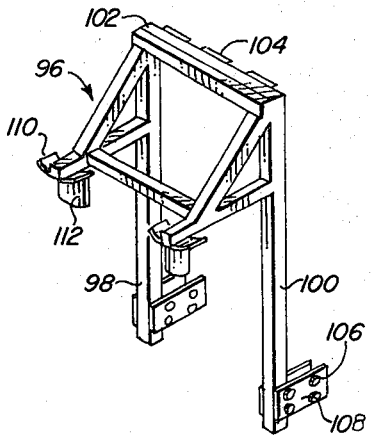
FIG. 8 is a perspective view of a detachable guide bracket in accordance with the present invention.
Figure 9:
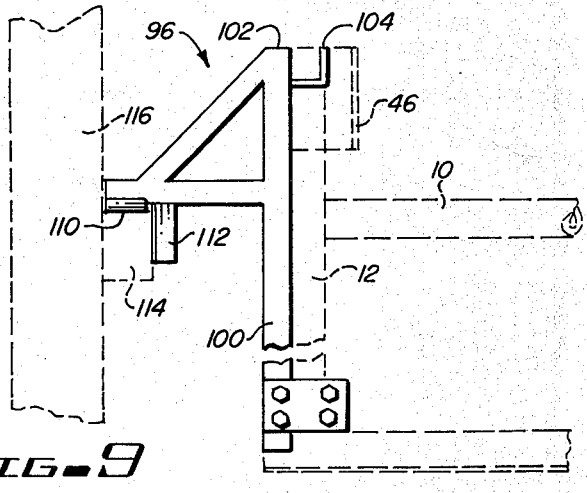
FIG. 9 illustrates the manner of attaching the detachable guide bracket to an end bracket of the screed and the relative positioning of the guide bracket with respect to a wall mounted guide rail.

Referring now to FIGS. 8 and 9, a detachable guide bracket forming a portion of the system of the present invention will now be described. Guide bracket 96 includes vertically oriented members 98 and 100 and a horizontal member 102 from which a group of three lips, such as lip 104, extend to from a three-sided rectangular aperture fro accomodiating the upper horizontally oriented strut of end bracket 12.

A pair or parallel oriented rectangular steel plates, such as plate 106, are secured to the lower portion of each side member 98 and 100. As guide bracket 96 is rotatably fitted to end bracket 12, each pair of plates coupled to the lower portion of side members 98 and 100 slip around the lower portion of the side members of end bracket 12. Securing means, such as a pair of nut/bolt units 108, is provided to draw the parallel plates together to securely clamp guide bracket 96 to end bracket 12.

Additional bracket structure of the type illustrated extends outward from the side of guide bracket 96 and includes a pair of curved, horizontally oriented guide faces 110 and a pair of curved, vertical oriented guide faces 112. Guide faces 110 and 112 are configured to slide along the exposed horizontal and vertical faces of a 2×4 guide member 114 which is secured to a wall 116. The weight of one end of the screed is thus supported by guide rail 14 as the screed is translatable along the length of the concrete which is being shaped.

Referring now to FIGS. 12, 13, 15 and 16, a detachable aluminum pan float finisher is disclosed. Pan 118 includes a plurality of apertures in alignment with the horizontal sections of the front and rear screed blades. Securing means are passed through the plurality of apertures in order to couple pan 118 to the lower surface of front and rear screed blades 16 and 18. The pan float finisher includes upward curved front and rear end sections to assist in smoothing freshly poured concrete.

Figure 15:
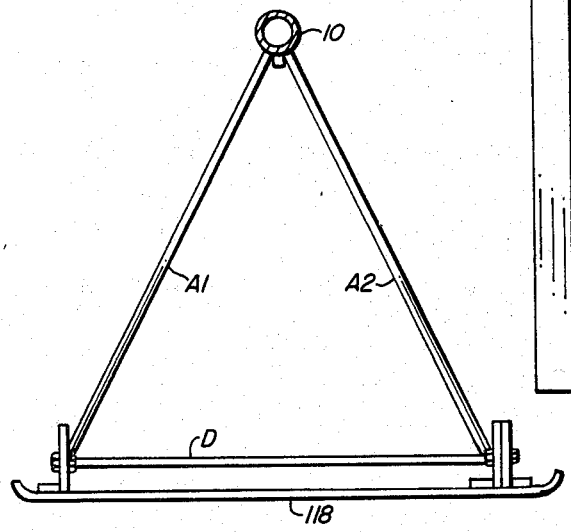
FIG. 15 is a sectional view of the screed illustrated in FIG. 12, taken along section line 15—15, particularly illustrating the manner in which the detachable bottom pan is coupled to the front and rear screed blades.
Figure 16:
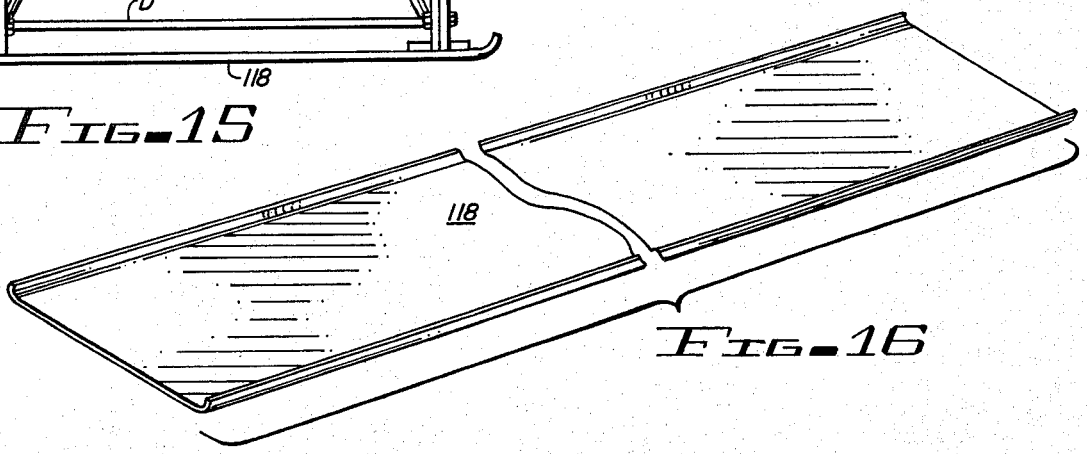
FIG. 16 illustrates the detachable pan float finisher of the present invention.

Referrng now to FIGS. 12, 13 and 15, pan float finisher 118 is shown coupled to the screed. These figures together with FIG. 14 also clearly illustrate the totality of the network of struts which form the open frame for the screed of the present invention. Similar strut elements in each figure are referred to by the same letter/-number designator, e.g. strut Al in FIG. 12 corresponds to strut Al in FIG. 14. Each strut is coupled at both ends by welded junctions to the remainder of the screed and to the various adjacent other struts.

It will be apparent to those skilled in the art that the disclosed vibrating concrete screed system may be modified in numerous ways and may assume many embodiments other than the preferred forms specifically set out and described above, Accordingly, it is intended by the appended claims to cover all such modifications of the invention which fall within the true spirit and scope of the invention.

I claim:

1. A screed for finishing freshly poured concrete lying in an area between opposing side forms, said screed comprising:

a. a triangular truss frame having first and second ends and a top support member forming the apex of said triangular truss;

b. front and rear screed blades extending between the first and second ends of said frame and coupled in a spaced apart relationship to the lower portion of the front and rear of said frame, said front and rear blades each including a flat lower surface and forming the front and rear edges of said triangular truss frame;

c. means coupled to said screed for vibrating said front and rear blades;

d. a pan float finisher coupled to the flat lower surface of said front and rear blades and having a length substantially equal to the length of said frame and a width greater than the spacing between said front and rear blades.

2. The pan float finisher of claim 1 further including means for detachably coupling said pan float finisher to said front and rear blades.

3. The screed of claim 1 wherein the lower surface of said pan float finisher forms a smooth surface parallel to the horizontal plane defined by the lower surfaces of said front and rear screed blades.

4. The screed of claim 1 wherein the front and rear edges of said pan float finisher extend beyond the outer edges of said front and rear screed blades and curve upwardly.

5. The screed of claim 1 further including first and second vertically oriented end brackets coupled to said top support member and to said front and rear screed blades at the first and second ends of said screed frame.

6. A screed for finishing freshly poured concrete lying in an area between opposing side forms, said screen comprising:

a. a triangular truss frame having first and second ends and a top support member forming the apex of said triangular truss;

b. front and rear screed blades extending between the first and second ends of said frame and coupled in a spaced apart relationship to the lower portion of the front and rear of said frame, said front and rear blades each including a flat surface and forming the front and rear edges of said triangular truss frame;

c. means coupled to said screed for vibrating said front and rear blades;

d. first and second vertically oriented end brackets coupled to said top support member and to said front and rear screed blades at the first and second ends of said screed frame; and e. a pan float finisher coupled to the flat lower surface of said front and rear blades and having a length substantially equal to the length of said frame and a width greater than the spacing between said front and rear blades, said pan float finisher forming a smooth surface parallel to the horizontal plane defined by the lower surfaces of said front and rear screed blades and including front and rear edges extending outward beyond said front and rear blades and curving upwardly.

* * * * *